US005156807A

United States Patent [19]

Nagata et al.

[11] Patent Number: 5,156,807

[45] Date of Patent: Oct. 20, 1992

[54] METHOD FOR IMPROVING MACHINABILITY OF TITANIUM AND TITANIUM ALLOYS AND FREE-CUTTING TITANIUM ALLOYS

[75] Inventors: Tatsuo Nagata, Amagasaki; Wataru Takahashi, Nishinomiya; Manabu Nishimoto, Amagasaki; Shiroh Kitayama, Kobe; Yoshihito Sugimoto, Kashiwa, all of Japan

[73] Assignee: Sumitomo Metal Industries, Ltd., Osaka, Japan

[21] Appl. No.: 769,253

[22] Filed: Oct. 1, 1991

[30] Foreign Application Priority Data

Oct. 1, 1990 [JP] Japan ..... 2-263427

[51] Int. Cl.[5] ..... C22C 14/00

[52] U.S. Cl. ..... 420/417; 148/421; 420/418

[58] Field of Search ..... 420/417, 418; 148/421

[56] References Cited

U.S. PATENT DOCUMENTS 4,810,465 5/1989 Kimura et al. ..... 420/417
4,874,577 10/1989 Wakita et al. ..... 420/417

FOREIGN PATENT DOCUMENTS 0573320 3/1959 Canada ..... 420/417
0199198 10/1986 European Pat. Off. .
60-251239 12/1985 Japan .
61-153247 7/1986 Japan .
61-257445 11/1986 Japan .
62-89834 4/1987 Japan .

*Primary Examiner*—Upendra Roy
*Attorney, Agent, or Firm*—Burns, Doane, Swecker & Mathis

[57] ABSTRACT

The machinability of titanium or a titanium alloy is improved without adversely affecting the hot workability and fatigue strength or corrosion resistance by addition of P: 0.01–1.0% along with one or both of S: 0.01–1.0% and Ni: 0.01–2.0%, or along with S: 0.01–1.0%, Ni: 0.01–2.0%, and REM: 0.01–5.0%, on a weight basis.

8 Claims, 1 Drawing Sheet

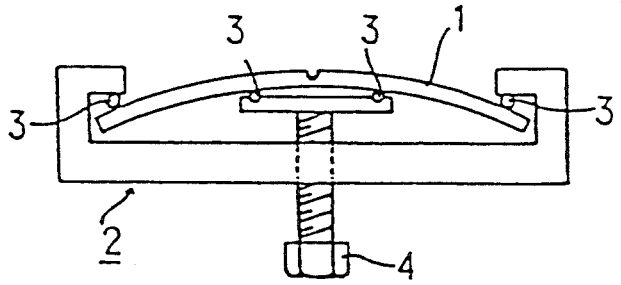
3
3
1
3
3
2
4

METHOD FOR IMPROVING MACHINABILITY OF TITANIUM AND TITANIUM ALLOYS AND FREE-CUTTING TITANIUM ALLOYS

BACKGROUND OF THE INVENTION

This invention relates to a method for improving the machinability of titanium (Ti) and titanium alloys. It also relates to free-cutting titanium alloys and method for the preparation thereof.

More particularly, the present invention relates to a method for improving the machinability of titanium and titanium alloys which are suitable for use in parts such as structural members of vehicles, including aircraft and automobiles and movable members of the engines of these vehicles which are required to be light weight and of high strength.

Pure titanium and titanium alloys find applications in parts of high speed vehicles such as aircraft and automobiles due to their light weight and high strength. However, in the manufacture of such parts from titanium or a titanium alloy by machining, the poor machinability of the material limits the tool life and the machining speed. Therefore, the machining process is costly and time-consuming and the mass-production of titanium or titanium alloy parts has been difficult. This is one of the reasons for the high costs of titanium or titanium alloy products.

It has been known that the machinability of titanium and titanium alloys is inferior to that of steels. The poor machinability of titanium and titanium alloys is thought to result from (i) an increased force imposed on the edge of a cutting tool due to the mechanism of the formation of cuttings inherent in titanium and its alloys, which causes the edge to be readily damaged, (ii) an increased cutting temperature, i.e., the temperature in the cut area due to the lower thermal conductivity of titanium and its alloys compared to steel, and (iii) a higher susceptibility of titanium to reaction with the cutting tool than steel as evidenced by the fact that titanium is more reactive with other elements than steel.

Accordingly, there is a continuing need to improve the machinability of titanium and titanium alloys.

It has been proposed that the machinability of titanium and titanium alloys can be improved by adding one or more elements selected from S (sulfur), Se (selenium), Te (tellurium), REM (rare earth metals), and Ca (calcium) [Japanese Patent Application Kokai Nos. 60-251239(1985), 61-153247(1986), 61-257445(1986), and 62-89834(1987), U.S. Pat. No. 4,810,465, and European Patent Publication No. 199,198]. These elements form inclusions in titanium or a titanium alloy and act to improve the machinability thereof. However, since the addition of such elements simultaneously causes a decrease in hot workability and mechanical strength (particularly fatigue strength), the amounts of these elements which can be added are limited. As a result, the addition of S, Se, Te, REM, and/or Ca in limited amounts not only cannot provide the resulting titanium alloy with a satisfactory improvement in machinability, but also degrades the hot workability and fatigue strength of the titanium alloy so that it is inferior to a conventional titanium or titanium alloy in hot workability and fatigue strength.

SUMMARY OF THE INVENTION

It is an object of the present invention to provide a method for improving the machinability of titanium and titanium alloys without significantly adversely affecting other properties thereof.

Another object of the invention is to provide a free-cutting titanium alloy having improved machinability while maintaining the desirable properties of light weight and high fatigue strength or corrosion resistance inherent in titanium or titanium alloys.

A further object of the invention is to provide a method for preparing such a free-cutting titanium alloy.

These and other objects can be accomplished by adding to titanium or a titanium alloy a combination of free-cutting elements selected from the following groups (a) to (d) on a weight basis:

(a) P:0.01–1.0% and S:0.01–1.0%,
(b) P:0.01–1.0% and Ni:0.01–2.0%,
(c) P:0.01–1.0%, S:0.01–1.0%, and Ni:0.01–2.0%, and
(d) P:0.01–1.0%, S:0.01–1.0%, Ni:0.01–2.0%, and REM:0.01–5.0%.

Accordingly, in one aspect, the present invention provides a method for improving the machinability of titanium or a titanium alloy comprising adding thereto a combination of free-cutting elements selected from the above-described groups (a) to (d).

In another aspect, the present invention resides in a free-cutting titanium alloy which comprises a combination of free-cutting elements selected from the above groups (a) to (d), the balance being essentially titanium or a titanium alloy.

The free-cutting titanium alloy according to the present invention can be readily prepared by melting titanium together with one or more sources of each of the free-cutting elements and, if present, alloying elements, wherein the source of phosphorus is selected from iron phosphide and titanium phosphide and the source of sulfur is selected from iron sulfide, aluminum sulfide, and titanium sulfide.

BRIEF DESCRIPTION OF THE DRAWING

The sole figure schematically shows a manner of applying stresses to a slightly notched four-point bending test piece in a sulfide corrosion resistance test.

DESCRIPTION OF THE INVENTION

The present inventors have found the following facts during investigations with the intention of improving the machinability of titanium (Ti) and titanium alloys.

(1) When phosphorus (P) is added to Ti or a Ti alloy, a part of P is dissolved in Ti to form a solid solution, thereby decreasing the ductility of the matrix, and the remainder of P reacts with Ti to form inclusions. A synergistic effect of the decrease in ductility of the matrix and the formation of the inclusions results in a significant improvement in machinability. However, the inclusions formed by addition of P are coarse and of irregular shape and they deteriorate the hot workability and fatigue strength of the resulting P-containing Ti alloy.

(2) When sulfur (S) is further added, S is dissolved as a solid solution in the inclusions formed by addition of P, thereby readily refining the inclusions. Therefore, the inclusions formed by the combined addition of P and S become finer and cause a smaller decrease in hot workability and fatigue strength than the inclusions formed by the addition of P alone.

(3) When nickel (Ni) is added along with P to Ti or a Ti alloy, Ni is partly dissolved as a solid solution in the inclusions formed by addition of P, thereby readily making the inclusions round. Therefore, the round shape inclusions formed by the combined addition of P and Ni cause a smaller decrease in hot workability and fatigue strength than the irregular and angular shape inclusions formed by the addition of P alone. Furthermore, the excess Ni remaining undissolved in the inclusions forms an intermetallic compound with Ti, thereby contributing to a further improvement in machinability.

(4) The effect of S on refinement of the inclusions and the effect of Ni on the shape thereof are attained by addition of both S and Ni to Ti or a Ti alloy along with P.

(5) A rare earth metal (REM) decreases the amount of dissolved P and lessens the decrease in ductility, thereby controlling the decrease in hot workability and fatigue strength. However, this leads to the formation of an increased amount of inclusions, since the excess P remaining undissolved in titanium is precipitated as inclusions. If the inclusions are coarse or of irregular shape, the increased amount of inclusions may cause a considerable decrease in hot workability and fatigue strength. Therefore, when an REM is added along with P, it is desirable that both of S and Ni be also added in order to refine and make round the resulting inclusions and minimize the decrease in hot workability and fatigue strength.

(6) The addition of P and S to Ti or a Ti alloy can be performed by using iron sulfide, aluminum sulfide, titanium sulfide, iron phosphide, and/or titanium phosphide as a phosphorus or sulfur source. Iron sulfide and iron phosphide are less expensive sources of sulfur and phosphorus, respectively, but the use of these iron (Fe) compounds results in the simultaneous addition of Fe. Since the addition of a large amount of Fe adversely affects the machinability of Ti or a Ti alloy, it is preferable that iron sulfide or iron phosphide, when used, be added in combination with other Fe-free sulfur or phosphorus source so as to control the amount of Fe added.

On the basis of these findings, according to the present invention, a free-cutting Ti alloy can be prepared from Ti or a Ti alloy as a base material by improving the machinability thereof by the addition of 0.01–1.0% by weight of P along with one or both of 0.01–1.0% by weight of S and 0.01–2.0% by weight of Ni, or along with a combination of 0.01–1.0% by weight of S, 0.01–2.0% by weight of Ni, and 0.01–5.0% by weight of REM, all these additives serving as free-cutting elements.

It is preferable in the preparation of the free-cutting Ti alloy that the source of P be selected from iron phosphide and titanium phosphide and the source of S be selected from iron sulfide, aluminum sulfide, and titanium sulfide.

When the base material to which one or more free-cutting elements selected from the above-described groups (a) to (d) are added is a Ti alloy, the composition of the base Ti alloy is not critical and the desired improvement in machinability can be achieved regardless of the composition of the base Ti alloy.

The base Ti alloy may contain one or more members selected from the following alloying elements in amounts up to the maximum contents indicated below in weight percent:

| | | | | |
|---|---|---|---|---|
| Al: 10%, | Sn: 15%, | Co: 10%, | Cu: 5%, | Ta: 15%, |
| Mn: 10%, | Hf: 10%, | W: 10%, | Si: 0.5%, | Nb: 20%, |
| Zr: 10%, | Mo: 20%, | V: 25%, | Fe: 10%, | C: 5%, |

-continued

| | | | | |
|---|---|---|---|---|
| Cr: 15%, | Pt: 0.25%, | Pd: 0.25%, | Ru: 0.25%, | Os: 0.25%, |
| Ir: 0.25%, | and Rh: 0.25%, | | | |

provided that, when the Ti alloy contains two or more alloying elements, the total content of the alloying elements does not exceed 50%.

Similarly, a commercial-grade pure Ti metal may comprise a minor amount of Fe, generally on the order of up to 2%, in order to improve the mechanical properties. Therefore, when the base material is Ti metal, Fe may be present in the base Ti metal.

Oxygen (0) may be present in the base Ti metal or Ti alloy in an amount of not greater than 0.5%. As is known in the art, such a small amount of oxygen serves to strengthen Ti or a Ti alloy and it is added in most commercial-grade Ti and Ti alloys.

Representative Ti alloys which can be improved in machinability according to the present invention include Ti-3Al-2.5V, Ti-6Al-4V, Ti-6Al-2Sn-4Zr-6Mo, Ti-10V-2Fe-3Al, Ti-15Mo-5Zr-3Al, Ti-15V-3Cr-3Sn-3Al, Ti-3Al-8V-6Cr-4Mo-4Zr, and Ti-0.15Pd.

The amount of each free-cutting element which can be added according to the present invention is defined for the reasons described below. In the following description, all the percents are, unless otherwise indicated, by weight.

Phosphorus (P)

Phosphorus is partly dissolved in Ti to form a solid solution and decrease the ductility of the matrix and the remaining part of phosphorus forms inclusions in Ti to improve the machinability. However, the addition of P alone causes a significant decrease in hot workability and fatigue strength. Therefore, P is added in combination with one or both of S and Ni, or with S, Ni, and REM.

When the content of P is less than 0.01%, neither the amount of P dissolved in the Ti matrix nor the amount of inclusions formed is enough to attain an appreciable improvement in machinability. The addition of P in an amount of greater than 1.0% causes the formation of coarse inclusions, resulting in a decrease in hot workability and fatigue strength, although the machinability is effectively improved. Therefore, P is present in an amount of 0.01–1.0%, preferably 0.03–0.30%, and more preferably 0.04–0.12%.

Sulfur

When sulfur is added along with P, it refines the inclusions formed by addition of P and minimizes the decrease in hot workability and fatigue strength caused thereby. The addition of less than 0.01% of S does not bring about an appreciable refinement of the inclusions so that the decrease in hot workability and fatigue strength cannot be suppressed adequately. When the content of S is greater than 1.0%, the inclusions are formed in an increased amount and many inclusions are present along the grain boundaries, thereby even resulting in a decrease in hot workability and fatigue strength. Therefore, when added, S is present in an amount of 0.01–1.0%, preferably 0.03–0.30%, and more preferably 0.08–0.24%.

When the weight ratio of S to P is within the range of from 1:3 to 3:1, the effect of S on refinement of the inclusions is particularly significant and fine inclusions having an average diameter of 1 to 10 μm are formed.

Thus, it is preferable that S be added in such an amount that the weight ratio of S:P be in the range of from 1:3 to 3:1 and more preferably from 1:2 to 2:1.

Nickel (Ni)

Nickel makes round the inclusions formed by addition of P and hence is effective for suppressing a decrease in hot workability and fatigue strength caused by addition of P. Furthermore, Ni forms an intermetallic compound with Ti, thereby improving the machinability. The addition of less than 0.01% Ni does not significantly improve the shape of the inclusions and therefore does not have an appreciable effect on suppression of a decrease in hot workability and fatigue strength. On the other hand, the addition of greater than 2.0% Ni causes the formation of a large amount of a Ti-Ni intermetallic compound, thereby decreasing the ductility and rather decreasing the hot workability and fatigue strength. Therefore, when added along with P, Ni is present in an amount of 0.01–2.0%, preferably 0.05–0.60%, and more preferably 0.15–0.50%.

Rare earth metals (REM)

Rare earth metals are reactive with P and serve to decrease the amount of P dissolved in the matrix, thereby lessening a decrease in ductility of the matrix and suppressing a decrease in hot workability and fatigue strength caused by addition of P. One or more REM such as La (lanthanum), Ce (cerium), (Nd) neodymium, Y (yttrium), Sc (scandium), etc. may be added in a total amount in the range of 0.01–5.0%, preferably 0.05–1.5%, and more preferably 0.20–1.0%. As described previously, since an REM tends to increase the amount of inclusions, it is added along with S and Ni in addition to P in order to refine and make round the inclusions.

The addition of an REM in an amount of less than 0.01% has little effect on alleviation of a decrease in ductility of the matrix and does not contribute to suppression of a decrease in hot workability and fatigue strength. The addition of an REM in an amount of greater than 5.0% causes an increase in the viscosity of the molten Ti or Ti alloy in which the REM is dissolved and tends to cause an undesirable segregation. An REM can be added relatively inexpensively by using a commercially available mischmetal which is an alloy of rare earth metals predominantly comprising Ce, La, and Nd.

The free-machining Ti alloy according to the present invention may contain incidental impurities such as hydrogen (H) and nitrogen (N) and it is preferable that the total amount of these incidental impurities be not greater than 0.1% and preferably not greater than 0.05%.

The free-machining Ti alloy of the present invention can be prepared by melting titanium together with one or more sources of each of the free-cutting elements to be added and, if present, alloying elements. For this purpose, any conventional method which has been used to prepare conventional Ti and Ti alloys, including the VAR (vacuum arc remelting) method and the arc melting method may be employed.

The source of P may be selected from iron phosphide and titanium phosphide, while the source of S may be selected from iron sulfide, aluminum sulfide, and titanium sulfide. Iron sulfide and iron phosphide are less expensive sources of S and P, respectively, but the use of these iron compounds results in the simultaneous addition of Fe. Since the addition of a large amount of Fe adversely affects machinability, it is preferable that the total amount of iron sulfide and iron phosphide added at this stage be restricted such that the resulting Ti alloy has an Fe content of not greater than 2.0% and more preferably not greater than 1.0%. Therefore, each of these iron compounds is preferably used in combination with another Fe-free sulfur or phosphorus source.

If desired, the resulting Ti alloy may be subjected to one or more of various thermal treating processes such as homogenizing, annealing, solution treatment, and ageing after or before it is worked by cold or hot forging or rolling, for example.

The Ti alloy according to the present invention is significantly improved in machinability over Ti and conventional Ti alloys yet has the favorable properties of light weight and high strength or good corrosion resistance inherent in the base Ti or Ti alloy. Therefore, it can be machined with significantly decreased costs to manufacture various products and hence contributes to a substantial decrease in the manufacturing costs of the products. The relatively low machining costs of the Ti alloy enables the alloy to be applied to the mass-production of parts of automobiles and similar vehicles.

The following examples describe the invention in more detail.

EXAMPLES

Example 1

Various Ti alloys having the compositions shown in Table 1 in which Alloys Nos. 1–25 were inventive Ti alloys, i.e., according to the present invention, Alloys Nos. 26–31 were conventional Ti metal or Ti alloys, and Alloys Nos. 32–46 were comparative Ti alloys were prepared in the form of ingots measuring 120 mm in diameter and 400 mm in length by melting according to the VAR method. All the ingots except for those of Alloys Nos. 24, 25, 30, and 31 were homogenized by heating at 1050° C. for 3 hour followed by air cooling. Thereafter, the diameter of each homogenized ingot was reduced to 90 mm by forging after heating to 1150° C. and then to 65 mm by forging after heating to 950° C.

In each of the forged comparative Ti alloys (Alloys Nos. 32–46), cracks were observed on the surface thereof but they are not so serious that test pieces could be taken by cutting.

The forged Ti alloys were annealed by heating for 1.5 hours at 705° C. followed by air cooling, and various test pieces including a compression test piece (8 mm diameter and 12 mm long), a rotating bent beam fatigue test piece (12 mm outer diameter and 110 mm long), and a drilling test piece (20 mm thick, 50 mm wide, and 350 mm long) were taken from each annealed Ti alloy to evaluate the hot workability, fatigue strength, and machinability, respectively, of the Ti alloy.

The ingots of the remaining Ti alloys, i.e., inventive Ti Alloys Nos. 24 and 25 and conventional Ti Alloys Nos. 30 and 31 prepared by the VAR method were similarly homogenized by heating for 3 hours at 1050° C. followed by air cooling and the diameter of the each ingot was then reduced to 65 mm by one-step forging after heating to 1050° C. The forged Ti alloys were then subjected to solution treatment by heating for 1 hour at 800° C. followed by air cooling, and a compression test piece and a drilling test piece of the above-described dimensions were taken from each of the Ti alloys to test for hot workability and machinability. The remaining Ti alloy materials were subjected to ageing for 15 hours at 500° C. followed by air cooling and a rotating bent beam fatigue test piece was taken from the aged material to test for fatigue strength.

The test results are also shown in Table 1.

The compression test was performed to evaluate the hot workability of a test piece under the following conditions:

| | |
|---|---|
| Temperature: | 750° C. |
| Strain rate: | 1 $sec^{-1}$ |
| Reduction rate: | 75%. |

The hot workability of each test alloy in compression was evaluated by visually observing the surface of the test piece after the compression test to determine the presence or absence of surface cracks. The symbol "O" indicates that no cracks were observed, while the symbol "X" indicates the formation of cracks.

All the comparative Ti alloys to which only P was added (Alloys Nos. 32 33, and 43) or which contained one or more of REM, Ni, P, and S in excessively large amounts (Alloys Nos. 34⟶and 44–46) were cracked, while no cracks were observed in any of the inventive Ti alloys (Alloys Nos. 1–25).

The rotating bent beam fatigue test was performed under the following conditions to determine the fatigue strength of a test piece after it was subjected to $10^7$ bending cycles.

| | |
|---|---|
| Test piece: | Ono-type rotating bent beam fatigue test piece, test diameter = 8 mm, |
| Temperature: | room temperature. |

In view of the test results with conventional pure Ti or Ti alloys which contained no free-cutting elements, the fatigue strength of each inventive and comparative alloy was considered to be good when it was equal to or higher than 24 kgf/$mm^2$ for those alloys based on pure Ti metal or equal to or higher than 45 kgf/$mm^2$ for those alloys based on Ti-6Al-4V alloy.

All the comparative Ti alloys (Alloys Nos. 32–46) had fatigue strength inferior to that of corresponding inventive Ti alloys based on the same base Ti or Ti alloy (Alloy No. 1–25) and did not exceed the above-described minimum acceptable fatigue strength.

The drilling test was performed under the following conditions.

| | |
|---|---|
| Tool material: | cemented carbide (equivalent to K20) |
| Drill diameter: | 6 mm |
| Feed: | 0.1 mm/revolution |
| Rotational speed: | 980 rpm |
| Lubricant: | water-soluble lubricant*, 4 l/min |
| Bore depth: | 15 mm (non-penetrating) |

*Commercially available under the tradename "Cosmocool".

The machinability of each test alloy was evaluated in terms of drilling capacity calculated from the drilling distance relative to pure Ti (Alloy No. 26) by the following equation:

$$\text{Drilling capacity} = \frac{\text{Drilling distance of test alloy}}{\text{Drilling distance of pure Ti}} \times 100$$

wherein the drilling distance is the product of the number of bores drilled before the lifetime of the drill multiplied by the bore depth.

All the inventive Ti alloys (Alloys Nos. 1–25) which contained P along with S and/or Ni showed drilling capacity superior to that of the corresponding base Ti or Ti alloy. Some of comparative alloys which contained P showed inferior drilling capacity due to the addition of an excessive amount of S, Ni, or REM (Alloys Nos. 37, 41, and 42).

As a result, it was concluded that the inventive Ti alloys had hot workability and fatigue strength at least equal to those of the corresponding conventional Ti or Ti alloys and were significantly improved in machinability.

TABLE 1

| No. | Chemical Composition (wt %) Ti | Al | V | Fe | Ni | REM | P | S | O | Others | Compression Test[1)] | Fatigue Strength[2)] (kgf/$mm^2$) | Drilling Capacity (%) | Based on |
|---|---|---|---|---|---|---|---|---|---|---|---|---|---|---|
| ALLOY COMPOSITION AND TEST RESULTS OF INVENTIVE TITANIUM ALLOYS | | | | | | | | | | | | | | |
| 1 | Bal. | — | — | 0.22 | — | — | 0.22 | 0.10 | 0.09 | | ○ | 26.1 | 435 | Pure Ti |
| 2 | " | — | — | 0.15 | 0.52 | — | 0.31 | — | 0.10 | | ○ | 26.2 | 447 | |
| 3 | " | — | — | 1.53 | 0.58 | — | 0.26 | 0.12 | 0.10 | | ○ | 29.5 | 274 | |
| 4 | " | — | — | 0.32 | 0.42 | Ce:0.34, La:0.19, Nd:0.09 | 0.22 | 0.24 | 0.12 | | ○ | 27.2 | 519 | |
| 5 | " | — | — | 0.34 | 0.50 | — | 0.82 | — | 0.11 | | ○ | 24.1 | 973 | |
| 6 | " | — | — | 0.74 | 0.31 | Ce:0.40, La:0.22, Nd:0.11 | 0.06 | 0.12 | 0.12 | | ○ | 27.8 | 248 | |
| 7 | " | — | — | 1.02 | 0.24 | Ce:0.23, La:0.13, Nd:0.06 | 0.12 | 0.16 | 0.11 | | ○ | 28.3 | 250 | |
| 8 | Bal. | 3.30 | 2.65 | 0.30 | 0.62 | Ce:0.26, La:0.15, Nd:0.07 | 0.20 | 0.18 | 0.13 | | ○ | 34.6 | 223 | Ti-3Al-2.5V |
| 9 | " | 3.28 | 2.62 | 0.97 | 0.30 | Ce:0.38, La:0.22, Nd:0.11 | 0.10 | 0.05 | 0.13 | | ○ | 38.3 | 143 | |
| 10 | " | 3.27 | 2.54 | 0.79 | 0.22 | Ce:0.19, La:0.11, Nd:0.05 | 0.06 | 0.10 | 0.14 | | ○ | 36.8 | 129 | |
| 11 | Bal. | 6.08 | 4.12 | 0.15 | — | — | 0.32 | 0.18 | 0.08 | | ○ | 47.1 | 242 | Ti-6Al-4V |
| 12 | " | 6.04 | 4.11 | 1.22 | — | — | 0.11 | 0.78 | 0.12 | | ○ | 45.6 | 236 | |
| 13 | " | 6.01 | 4.10 | 0.73 | 0.18 | — | 0.22 | — | 0.10 | | ○ | 45.0 | 135 | |
| 14 | " | 6.03 | 4.15 | 0.24 | 1.35 | — | 0.22 | — | 0.11 | | ○ | 49.1 | 155 | |
| 15 | " | 6.02 | 4.12 | 0.08 | 0.68 | — | 0.33 | 0.28 | 0.11 | | ○ | 48.1 | 358 | |
| 16 | " | 6.08 | 4.11 | 0.31 | 0.42 | Ce:0.12, La:0.06, Nd:0.03 | 0.25 | 0.20 | 0.14 | | ○ | 52.0 | 228 | |
| 17 | " | 6.06 | 4.14 | 0.70 | 0.32 | Ce:2.71, La:1.53, Nd:0.76 | 0.50 | 0.40 | 0.20 | | ○ | 53.2 | 324 | |

TABLE 1-continued

| No. | Ti | Al | V | Fe | Ni | REM | P | S | O | Others | Compression Test[1)] | Fatigue Strength[2)] (kgf/mm²) | Drilling Capacity (%) | Based on |
|---|---|---|---|---|---|---|---|---|---|---|---|---|---|---|
| | Chemical Composition (wt %) | | | | | | | | | | | | | |
| 18 | " | 6.04 | 4.12 | 0.35 | 0.48 | Ce:0.52, La:0.30, Nd:0.15 | 0.41 | 0.42 | 0.12 | | ○ | 50.8 | 291 | |
| 19 | " | 6.02 | 4.11 | 1.12 | 0.40 | Ce:0.43, La:0.24, Nd:0.12 | 0.15 | 0.07 | 0.13 | | ○ | 52.8 | 151 | |
| 20 | " | 6.03 | 4.13 | 1.04 | 0.25 | Ce:0.21, La:0.12, Nd:0.06 | 0.09 | 0.15 | 0.13 | | ○ | 53.4 | 143 | |
| 21 | " | 6.05 | 4.11 | 1.02 | 0.22 | Ce:0.22, La:0.12, Nd:0.06 | 0.25 | — | 0.16 | | ○ | 51.4 | 140 | |
| 22 | " | 6.01 | 4.03 | 0.78 | 0.20 | Y:0.31 | 0.12 | 0.06 | 0.14 | | ○ | 52.3 | 152 | |
| 23 | " | 5.98 | — | 0.62 | 1.36 | Ce:0.41, La:0.23, Nd:0.11 | 0.28 | 0.10 | 0.16 | Sn:2.05, Zr:3.99, Mo:6.02 | ○ | 54.8 | 151 | Ti-6Al-2Sn-4Zr-6Mo |
| 24 | " | 3.01 | — | 0.58 | 1.47 | Ce:0.52, La:0.30, Nd:0.15 | 0.32 | 0.15 | 0.18 | Mo:15.10, Zr:5.03 | ○ | 61.4 | 91 | Ti-15Mo-5Zr-3Al |
| 25 | " | 3.00 | 15.02 | 0.64 | 1.38 | Ce:0.51, La:0.29, Nd:0.14 | 0.34 | 0.14 | 0.18 | Cr:3.01, Sn2.99 | ○ | 58.2 | 104 | Ti-15V-3Cr-3Sn-3Al |
| | ALLOY COMPOSITION AND TEST RESULTS OF CONVENTINAL AND COMPARATIVE Ti AND Ti ALLOYS | | | | | | | | | | | | | |
| 26 | Bal. | — | — | 0.09 | — | — | — | — | 0.08 | | ○ | 24.2 | 100 | Pure Ti |
| 27 | " | 6.02 | 4.13 | 0.16 | — | — | — | — | 0.11 | | ○ | 45.6 | 43 | Ti-6Al-4V |
| 28 | Bal. | 3.28 | 2.61 | 0.09 | — | — | — | — | 0.11 | | ○ | 33.5 | 59 | Ti-3Al-2.5V |
| 29 | " | 6.01 | — | 0.10 | — | — | — | — | 0.10 | Sn:2.02, Zr:3.98, Mo:6.01 | ○ | 53.2 | 34 | Ti-6Al-2Sn-4Zr-6Mo |
| 30 | " | 3.03 | — | 0.11 | — | — | — | — | 0.10 | Mo:15.06, Zr:5.01 | ○ | 62.3 | 30 | Ti-15Mo-5Zr-3Al |
| 31 | " | 2.98 | 15.04 | 0.12 | — | — | — | — | 0.12 | Cr:2.98, Sn:3.01 | ○ | 57.4 | 32 | Ti-15V-3Cr-3Sn-3Al |
| 32 | Bal. | 6.05 | 4.12 | 0.12 | *— | — | 0.12 | *— | 0.09 | | x | 42.8 | 87 | Ti-6Al-4V |
| 33 | " | 6.03 | 4.10 | 0.64 | *— | — | 0.85 | *— | 0.12 | | x | 44.0 | 293 | |
| 34 | " | 6.04 | 4.10 | 0.24 | — | — | *1.81 | — | 0.18 | | x | 30.2 | 373 | |
| 35 | " | 6.04 | 4.10 | 0.72 | — | — | 0.62 | *1.60 | 0.14 | | x | 16.8 | 362 | |
| 36 | " | 6.06 | 4.14 | 0.32 | — | — | *1.78 | 0.62 | 0.21 | | x | 22.9 | 358 | |
| 37 | " | 6.02 | 4.12 | 1.40 | *2.21 | — | 0.62 | — | 0.16 | | x | 31.8 | 30 | |
| 38 | " | 6.04 | 4.12 | 0.73 | 0.74 | — | *1.82 | — | 0.19 | | x | 27.4 | 274 | |
| 39 | " | 6.02 | 4.11 | 0.21 | *2.44 | — | 0.52 | 0.61 | 0.17 | | x | 22.1 | 49 | |
| 40 | " | 6.04 | 4.12 | 0.72 | 0.61 | — | *1.24 | *1.32 | 0.22 | | x | 18.4 | 397 | |
| 41 | " | 6.01 | 4.10 | 0.14 | 0.42 | *Ce:4.11, La:2.3, Nd:1.1 | 0.50 | 0.48 | 0.14 | | x | 28.2 | 28 | |
| 42 | " | 6.08 | 4.14 | 1.52 | 0.39 | *Ce:4.02, La:2,26, Nd:1.13 | 1.21 | *1.40 | 0.20 | | x | 22.7 | 41 | |
| 43 | Bal. | — | — | 0.15 | *— | — | 0.32 | *— | 0.10 | | x | 21.6 | 420 | Pure Ti |
| 44 | " | — | — | 0.48 | 0.51 | Ce:0.79, La:0.45, Nd:0.22 | *1.42 | *1.38 | 0.22 | | x | 8.8 | 942 | |
| 45 | " | — | — | 0.64 | *2.12 | Ce:0.65, La:0.36, Nd:0.18 | 0.52 | 0.50 | 0.17 | | x | 11.3 | 372 | |
| 46 | " | — | — | 0.52 | 0.62 | *Ce:4.12, La:2.31, Nd:1.15 | 0.49 | 0.51 | 0.16 | | x | 9.8 | 251 | |

[1)]○: No crack, x: Cracked;
[2)]Measured by a rotating bent beam fatigue test;
*Outside the alloy composition defined herein.

Example 2

Some of the inventive Ti alloys used in Example 1, i.e., Alloys Nos. 1, 3, 11, 13, 15, and 16 were subjected to a compression test with a higher reduction rate than in Example 1. The temperature and strain rate were the same as used in Example 1, i.e., 750° C. and 1 $sec^{-1}$, respectively, while the reduction rate was increased to 85% and 90%. The hot workability was evaluated in the same manner as in Example 1, i.e., by the presence or absence of surface cracks on a test piece.

The test results are shown in Table 2 along with those obtained with a 75% reduction rate in Example 1.

TABLE 2

| Alloy No. | Reduction Rate 75% | 85% | 90% | Base Material |
|---|---|---|---|---|
| 1 | ○ | ○ | x | Pure Ti metal |

TABLE 2-continued

| Alloy No. | Reduction Rate 75% | 85% | 90% | Base Material |
|---|---|---|---|---|
| 3 | ○ | ○ | ○ | |
| 11 | ○ | x | x | Ti-6Al-4V alloy |
| 13 | ○ | x | x | |
| 15 | ○ | ○ | x | |
| 16 | ○ | ○ | ○ | |

The inventive Ti alloy based on pure Ti to which P and S were added (Alloy No. 1) was cracked by compression with a reduction rate of 90%, while Alloys Nos. 3 to which P, S, and Ni were added withstood a 90% reduction rate without cracking.

The inventive Ti alloys based on Ti-6Al-4V alloy to which P was added along with either S or Ni (Alloys Nos. 11 and 13) were cracked by compression with 85% reduction rate. Alloy No. 15 to which P was added along with S and Ni and Alloy No. 16 to which REM was further was added withstood an 85% reduction rate and a 90% reduction rate, respectively, without cracking.

Example 3

This example illustrates that the improvement in machinability attained by the present invention can be attained also with platinum group metal-containing Ti alloys which have excellent corrosion resistance.

Various Ti alloys having the compositions shown in Table 3 in which Alloys Nos. 51–58 were inventive Ti alloys and Alloys Nos. 59–66 were conventional Ti alloys were prepared in the form of ingots measuring 120 mm in diameter and 400 mm in length by melting according to the VAR method. All the ingots were homogenized by heating at 1050° C. for 3 hour followed by air cooling.

The diameter of each homogenized ingot of inventive Ti Alloys Nos. 51–55 and 58 and comparative Ti Alloys Nos. 59–63 and 66 was reduced to 90 mm by forging after heating to 1150° C. and was further reduced to 65 mm by forging after heating to 950° C. The forged Ti alloys were annealed by heating for 1.5 hours at 705° C. followed by air cooling and various test pieces including a drilling test piece having the same dimensions as described in Example 1, small test pieces for an acid resistance test (3 mm thick, 10 mm wide, and 40 mm long), crevice corrosion test pieces (3 mm thick, 30 m wide, and 30 mm long), and a sulfide corrosion test piece (2 mm thick, 10 mm wide, and 75 mm long) were taken from each annealed Ti alloy and fabricated for their respective tests.

The ingots of the remaining Ti alloys, i.e., inventive Ti Alloys Nos. 56 and 57 and conventional Ti Alloys Nos. 64 and 65 were, after the above-described homogenizing, subjected to forging after heating to 1050° C. to reduce the diameter to 65 mm in one step. The forged Ti alloys were then subjected to solution treatment by heating for 1 hour at 800° C. followed by air cooling, and the above-described test pieces for drilling, acid resistance, crevice corrosion resistance, and sulfide corrosion resistance tests were taken from each Ti alloy and fabricated for their respective tests.

The acid resistance test was performed by immersing a thin rectangular test piece measuring 3 mm(t)×10 mm(w)×40 mm(1) which had been polished with #600 emery paper in a boiling aqueous 5% HCl solution for 6 hours, and then determining the weight loss of general corrosion by weighing the test piece before and after immersion. The corrosion rate was then calculated from the corrosion weight loss. Two test pieces were used in this test to show the results of acid resistance as an average corrosion rate.

The crevice corrosion test was performed using a pair of crevice corrosion test pieces each measuring 3 mm(t)×30 mm(w)×30 mm(1). After each test piece was drilled to form a hole 7 mm in diameter at the center thereof and polished with #600 emery paper, an anaerobic adhesive based on a dimethacrylate-type resin was applied to the surface of each test piece facing the other test piece and the two test pieces were clamped together through a Teflon TM bushing using a bolt and a nut both made of titanium.

Three pairs of crevice corrosion test pieces were fabricated as above for each Ti alloy material to be tested and they were immersed for 500 hours in an aqueous 25% NaCl solution (pH 2) at 150° C. The resistance to crevice corrosion was evaluated by visually observing the facing surfaces of the test pieces after immersion. The symbol "O" indicates that none of the test pieces showed any sign of crevice corrosion.

The sulfide corrosion test was performed using a four-point bending test piece measuring 2 mm(t)×10 mm(w)×75 mm(1) which was notched with a small groove having a semicircular cross-section of 0.25 mm in radius and 0.25 mm in depth extending in the widthwise direction at the center of the length of the test piece.

As shown in the accompanying figure, a four-point bending test piece 1 slightly notched as described above was mounted on a four-point bending jig 2 and supported therein by four glass round rods 3 which functioned as fulcrums. A stress equivalent to 100% yield stress was applied to the test piece by means of a stressing bolt 4, and the test piece was exposed to a corrosive environment for 720 hours in an autoclave containing a corrosive solution under the following conditions:

| | |
|---|---|
| Corrosive solution: | aqueous solution containing 25% NaCl and 1 g/l of S |
| Solution temperature: | 250° C. |
| Vapor phase partial pressure: | 10 kgf/cm$^2$ $H_2S$, 10 kgf/cm$^2$ $CO_2$ |
| Testing period: | 720 hours |
| Stress applied: | $1 \times \sigma_{0.2}$ |

The resistance to sulfide corrosion was evaluated by visually observing the exposed test piece to determine the presence or absence of signs of stress-corrosion cracking (SCC). The symbol "0" indicates that no signs of SCC were observed.

The drilling capacity was tested and evaluated in the same manner as described in Example 1.

As can be seen from the results shown in Table 3, all the inventive Ti alloys (Alloys Nos. 51–58) were improved over the conventional Ti alloys (Alloys Nos. 59–66) with respect to drilling capacity, while they had corrosion resistance comparable to that of the conventional Ti alloys. Therefore, it is apparent that the present invention can improve the machinability of platinum group metal-containing Ti alloys which are useful as a rotating shaft in chemical plants, for example.

The principles, preferred embodiments, and mode of operation of the present invention have been described. The present invention, however, is not to be construed as limited to the particular forms disclosed, since these forms are to be regarded ad illustrative rather than restrictive. Variations and modifications may be made by those skilled in the art without departing from the spirit of the invention.

TABLE 3

ALLOY COMPOSITION AND TEST RESULTS OF INVENTIVE AND CONVENTIONAL TITANIUM ALLOYS

| | Chemical Composition (wt %) | | | | | | | | | |
|---|---|---|---|---|---|---|---|---|---|---|
| No. | Ti | Al | V | Fe | Ni | REM | P | S | Ru | Pd |
| 51 | Bal. | — | 11 — | 0.07 | 0.30 | Ce:0.31, La:0.15 | 0.06 | 0.12 | — | 0.07 |

TABLE 3-continued

ALLOY COMPOSITION AND TEST RESULTS OF INVENTIVE AND CONVENTIONAL TITANIUM ALLOYS

| | | | | | | | | | | |
|---|---|---|---|---|---|---|---|---|---|---|
| | | | | | | Nd:0.07 | | | | |
| 52 | " | — | — | 0.08 | 0.25 | Ce:0.42, La:0.21 Nd:0.10 | 0.07 | 0.13 | — | 0.07 |
| 53 | " | 6.13 | 3.98 | 0.18 | 0.29 | Ce:0.21, La:0.12 Nd:0.06 | 0.09 | 0.15 | 0.05 | 0.05 |
| 54 | " | 6.26 | 4.19 | 0.23 | 0.04 | Ce:0.15, La:0.08 Nd:0.04 | 0.42 | 0.14 | 0.08 | 0.03 |
| 55 | " | 6.01 | — | 0.19 | 0.31 | Ce:0.26, La:0.14 Nd:0.07 | 0.10 | 0.21 | 0.05 | 0.08 |
| 56 | " | 3.05 | — | 0.19 | 0.12 | Ce:0.31, La:0.14 Nd:0.07 | 0.08 | 0.28 | 0.12 | 0.07 |
| 57 | " | 2.98 | 15.00 | 0.21 | 0.61 | Ce:0.25, La:0.12 Nd:0.06 | 0.16 | 0.16 | 0.05 | 0.12 |
| 58 | " | 3.11 | 2.43 | 0.09 | 0.18 | Ce:0.19, La:0.43 Nd:0.21 | 0.31 | 0.16 | 0.12 | 0.12 |
| 59 | Bal. | — | — | 0.08 | — | — | — | — | — | 0.08 |
| 60 | " | — | — | 0.08 | — | — | — | — | — | 0.07 |
| 61 | " | 6.01 | 4.02 | 0.19 | — | — | — | — | 0.04 | 0.05 |
| 62 | " | 6.18 | 4.10 | 0.24 | — | — | — | — | 0.07 | 0.03 |
| 63 | " | 6.03 | — | 0.18 | — | — | — | — | 0.04 | 0.07 |
| 64 | " | 2.99 | — | 0.20 | — | — | — | — | 0.12 | 0.07 |
| 65 | " | 3.01 | 15.01 | 0.19 | — | — | — | — | 0.05 | 0.12 |
| 66 | " | 3.02 | 2.56 | 0.11 | — | — | — | — | 0.12 | 0.12 |

| | Chemical Composition (wt %) | | | Drilling | Corrosion Resistance | | | |
|---|---|---|---|---|---|---|---|---|
| | | | | | Acid | | Sulfide Corrosion | |
| No. | Co | O | Others | Capacity (%) | (Corrosion Rate (mm/year) | Crevice Corrosion[1)] | Rate (mm/y) | SCC[2)] |
| 51 | — | 0.10 | | 254 | 033 | ○ | 0.0005 | ○ |
| 52 | 0.32 | 0.06 | | 268 | 0.22 | ○ | 0.0003 | ○ |
| 53 | 0.34 | 0.22 | | 160 | 0.21 | ○ | 0.0003 | ○ |
| 54 | 4.21 | 0.16 | | 264 | 0.22 | ○ | 0.0004 | ○ |
| 55 | 0.31 | 0.19 | Sn:2.12, Zr:4.01 Mo:6.21 | 143 | 0.16 | ○ | 0.0002 | ○ |
| 56 | 0.30 | 0.20 | Zr:4.98, Mo:15.02 | 132 | 0.13 | ○ | 0.0002 | ○ |
| 57 | 0.52 | 0.18 | Sn:3.01, Cr:2.99 | 141 | 0.09 | ○ | 0.0001 | ○ |
| 58 | 0.36 | 0.22 | | 284 | 0.06 | ○ | 0.0001 | ○ |
| 59 | — | 0.10 | | 102 | 0.31 | ○ | 0.0005 | ○ |
| 60 | 0.30 | 0.08 | | 99 | 0.20 | ○ | 0.0004 | ○ |
| 61 | 0.32 | 0.21 | | 46 | 0.20 | ○ | 0.0003 | ○ |
| 62 | 4.11 | 0.15 | | 45 | 0.21 | ○ | 0.0002 | ○ |
| 63 | 0.29 | 0.22 | Sn:2.09, Zr:3.99 Mo:6.11 | 33 | 0.15 | ○ | 0.0002 | ○ |
| 64 | 0.30 | 0.21 | Zr:5.02, Mo:14.99 | 31 | 0.12 | ○ | 0.0002 | ○ |
| 65 | 0.52 | 0.23 | Sn:2.91, Cr:3.03 | 31 | 0.08 | ○ | 0.0001 | ○ |
| 66 | 0.37 | 0.19 | | 60 | 0.05 | ○ | 0.0001 | ○ |

[1)]○: No crevice corrosion observed;
[2)]○: No occurrence of SCC.

What is claimed is:

1. A free-cutting titanium alloy which comprises a combination of free-cutting elements selected from the following groups (a) to (d) on a weight basis:

(a) P:0.01–1.0% and S:0.01–1.0%, (b) P:0.01–1.0% and Ni:0.01–2.0%, (c) P:0.01–1.0%, S:0.01–1.0%, and Ni:0.01–2.0%, (d) P:0.01–1.0%, S:0.01–1.0%, Ni:0.01–2.0%, and REM:0.01–5.0%, the balance being essentially titanium or a titanium alloy.

2. The titanium alloy of claim 1, wherein the titanium or titanium alloy constituting the balance contains at most 0.5% by weight of oxygen and/or at most 2% by weight of iron.

3. The titanium alloy of claim 1, wherein the balance is essentially a titanium alloy which contains one or more alloying elements selected from Al, Sn, Co, Cu, Ta, Mn, Hf, W, Si, Nb, Zr, Mo, V, Fe, C, Cr, Pt, Pd, Ru, Os, Ir, and Rh.

4. The titanium alloy of claim 1, wherein the balance is essentially a titanium alloy which is selected from Ti-3Al-2.5V, Ti-6Al-4V, Ti-6Al-2Sn-4Zr-6Mo, Ti-10V-2Fe-3Al, Ti-15Mo-5Zr-3Al, Ti-15V-3Cr-3Sn-3Al, Ti-3Al-8V-6Cr-4Mo-4Zr, and Ti-0.15Pd.

5. The titanium alloy of claim 1, wherein the amounts of the free-cutting elements are in the following ranges on a weight basis:

P:0.03–0.30%, S:0.03–0.30%, Ni:0.05–0.60%, and REM: 0.05–1.5%.

6. The titanium alloy of claim 1, wherein the free-cutting elements are those of group (d).

7. The titanium alloy of claim 6, wherein the amounts of the free-cutting elements are in the following ranges on a weight basis:

P:0.03–0.30%, S:0.03–0.30%, Ni:0.05–0.60%, and REM:0.05–1.5%.

8. The titanium alloy of claim 7, wherein the amounts of the free-cutting elements are in the following ranges on a weight basis:

P:0.04–0.12%, S:0.08–0.24%, Ni:0.15–0.50%, and REM 0.20–1.0%.

* * * * *